US005426000A

United States Patent [19]

Labib et al.

[11] Patent Number: 5,426,000

[45] Date of Patent: Jun. 20, 1995

[54] COATED REINFORCING FIBERS, COMPOSITES AND METHODS

[75] Inventors: Mohamed E. Labib, Princeton; Bawa Singh, Voorhees, both of N.J.

[73] Assignee: AlliedSignal Inc., Morris Township, Morris County, N.J.

[21] Appl. No.: 925,501

[22] Filed: Aug. 5, 1992

[51] Int. Cl.[6] ..... B22F 3/00

[52] U.S. Cl. ..... 428/547; 428/549; 428/552; 428/565; 428/567; 428/568; 428/569; 428/608; 428/366; 428/367; 428/378; 428/379; 428/380; 428/381; 428/389

[58] Field of Search ..... 428/548, 549, 551, 552, 428/565, 567, 568, 569, 539.5, 605, 606, 607, 608, 366, 367, 378, 379, 380, 381, 389, 547

[56] References Cited

U.S. PATENT DOCUMENTS

| | | | |
|---|---|---|---|
| 4,132,828 | 1/1979 | Nakamura et al. | 428/366 |
| 4,278,729 | 7/1981 | Gibson et al. | 428/368 |
| 4,733,816 | 3/1988 | Eylon et al. | 228/190 |
| 4,786,566 | 11/1988 | Siemers | 428/568 |
| 4,847,044 | 7/1989 | Ghosh | 419/8 |
| 5,030,277 | 7/1991 | Eylon et al. | 75/229 |
| 5,227,249 | 7/1993 | Lukco et al. | 428/614 |
| 5,238,741 | 8/1993 | Knights et al. | 428/366 |
| 5,244,748 | 9/1993 | Weeks, Jr. et al. | 428/614 |

*Primary Examiner*—Peter A. Nelson
*Assistant Examiner*—Chrisman D. Carroll
*Attorney, Agent, or Firm*—Perman & Green

[57] ABSTRACT

Fiber-reinforced titanium alloy and intermetallic matrix composites having improved stability and tensile strength properties at elevated temperatures. The base reinforced fibers are pre-coated with a tailorable tri-layer coating, such as Ti—TiN—Ti. Preferably the TiN layer is graded so as to have metal-rich outer surfaces, such as titanium-rich TiN, providing excellent bonding affinity for the base titanium layer, bonded to the surface of the fibers, such as silicon carbide, and for the outer titanium layer, bonded to the titanium aluminum matrix, and a compound core, such as stoichiometric TiN, providing a stable interfacial barrier against chemical reactions, whereby the tensile strength and resistance to cracking of the composite is preserved even at elevated temperatures of 900° C. or higher.

9 Claims, No Drawings

COATED REINFORCING FIBERS, COMPOSITES AND METHODS

BACKGROUND OF THE INVENTION

1. Field of the Invention

The present invention relates to fiber-reinforced metallic matrix composites, novel coated reinforcing fibers for use therein and methods for producing such fibers and composites.

Fiber-reinforced metallic matrix composites commonly are based upon metal alloy systems having good resistance to oxidation and erosion and good strength properties at elevated temperatures, such as titanium alloys, superalloys, intermetallics, etc., and are used in gas turbine engine compressor and turbine components.

2. Discussion of Prior Art

Reference is made to commonly-assigned U.S. Pat. Nos. 4,816,347, 4,896,815 and 5,024,889 for their disclosure of fiber-reinforced titanium alloy matrix composite materials and methods for producing such composite materials, such as by hot isostatic pressing laminates of interposed titanium alloy layers and layers or fabrics of conventional reinforcing fibers. Such fibers frequently comprise core materials, such as boron or carbon (graphite), which are barrier-coated with compatible ceramic materials, such as boron carbide or silicon carbide, in an effort to insulate them against reaction with the metal matrix layers, such as titanium-aluminum alloys.

Reference is also made to U.S. Pat. Nos. 4,010,884, 4,141,802 and 4,499,156, each of which discloses fiber-reinforced metal matrix composite (MMC) materials incorporating fibers which are coated. The latter patent discloses titanium alloy composites incorporating barrier-coated fibers such as silicon carbide-coated boron and formed under temperature and pressure conditions which reduce the amount of reaction at the interfacial zone between the fiber and the alloy matrix. Such a reaction between the titanium alloy and the fiber material forms TiB, TiC, cracking, etc., resulting in severe degradation of tensile strength, particularly at elevated temperatures.

Problems are encountered with known fiber-reinforced metal matrix composites, particularly cracking and severe degradation of tensile strength at elevated temperatures. Stresses are encountered due to thermal coefficient mismatches and/or chemical reactivity between the fibers, generally of elements including boron, carbon, silicon, beryllium or refractory materials, such as silicon carbide (SIC), aluminum oxide or single crystal sapphire ($Al_2O_3$), and the metal-matrix, such as Ti—6Al—4V or alpha-2 (titanium aluminide, Ti—2-3Al—10Nb—3V—1Mo).

The application of the refractory surface coating to the fiber, to reduce interfacial problems, such as incompatibility and chemical reaction, between the fiber core and the metal matrix produces satisfactory results except under severe conditions of temperature and stress. Known refractory fiber coating materials include compounds such as oxides, nitrides, borides, silicides and carbides of elements such as silicon, boron, titanium, aluminum, etc. However, such barrier layers generally are unsatisfactory at elevated temperatures, due to their unsatisfactory bonding properties to the metal matrix, and/or thermal expansion mismatch resulting in delamination or disbonding, cracking and severe degradation of the tensile strength of the composite during thermal cycling.

Reference is made to commonly-assigned U.S. Pat. Nos. 5,024,889; 4,628,002; 4,415,609; 4,340,636; 4,315,968 and 4,142,008 each of which discloses the preparation of reinforcing ceramic fibers such as silicon carbide by the vapor deposition of coatings to a fiber core for purposes of improving the strength, bonding properties, inertness and/or other properties of the fiber when incorporated into a metla matrix for reinforcement purposes.

Advanced gas turbine engines require new materials that can be used under severe temperatures and mechanical stresses. These demanding requirements limit the choice of materials to very few candidates. Fiber-reinforced composites based on titanium alloys and intermetallics are candidates for such applications because of their low densities and high temperature capabilities. However, several fundamental problems must be solved for the successful application of these materials.

The fiber and matrix must retain useful mechanical properties at high temperatures, and must possess chemical compatibility inside the composite. Fiber reaction with the matrix at high temperatures often leads to the formation of an interfacial reaction zone, which causes deterioration in the mechanical strength of the composite. Thermal expansion mismatch between the fiber and matrix can result in matrix cracking in the interface region that results in loss of performance.

All of the critical problems involve processes occurring in the interfacial region between the fiber and matrix. Since the choice of fibers is very limited, the development of new fiber coatings provides a means to control the properties of the interfacial region.

The objective of the present invention is to provide novel intermediate layers (between fiber and matrix) in minimizing stress due to thermal expansion mismatch between the fiber and matrix.

Thus there is a need for improved coated ceramic reinforcing fibers for titanium alloy and intermetallic matrix composites, such as improved silicon carbide fibers, having strong bonding affinity for titanium alloy and intermetallic metal matrix materials over a wide range of temperatures, and which provide a stable barrier interface between the fiber and the metal matrix, preventing chemical reaction and other interfacial problems therebetween, particularly at elevated temperatures.

SUMMARY OF THE INVENTION

The present invention is based upon the discovery that improved interfacial barrier coated fibers are provided, having both chemical reaction barrier properties and excellent bonding strength for both the base reinforcing fiber and for titanium alloys and intermetallic matrices reinforced therewith, over a wide range of temperatures, due to a closer matching of compatibilities and heat-expansion properties, by the application of a novel multi-layer refractory coating to the surface of the reinforcing fibers. The present multi-layer refractory coatings contain an intermediate or central layer of a nitride, boride, carbide, oxide, or silicide of a refractory metal which is present in or alloyable with a metal present in the titanium alloy or intermetallic matrix, such as titanium, tantalum, tungsten, molybdenum, zirconium, hafnium, vanadium, niobium, chromium, etc., sandwiched between inner and outer metal layers of such refractory metal. The intermediate or central layer preferably is a graded layer which becomes richer in metal content outwardly from the center to the inner and outer surfaces, which are richer in content of the refractory metal. The inner metal layer had excellent bonding properties for the reinforcing fiber on which the coating is deposited, such as silicon carbide, and the outer metal surface layer has excellent bonding properties for the metal matrix into which the coated fibers are introduced to produce the MMC materials.

The present multi-layer coatings are tri-phase or tri-layer coatings applied by conventional chemical vapor deposition (CVD) or magnetron sputtering processes as integrated coatings of varying or graded composition produced from different target materials and/or different gaseous atmospheres. Thus, reactive sputtering of a titanium target causes the initial deposition of a pure titanium inner or base layer onto the fiber, such as the graded silicon carbide-coated carbon core fibers of commonly-assigned U.S. Pat. No. 4,315,968 or other conventional refractory-coated reinforcing fibers; the gradual introduction of a nitrogen/argon gas mixture causes the co-deposition of titanium and of titanium nitride until stoichiometric amounts of titanium and nitrogen are present and a golden yellow stoichiometric titanium nitride central area is deposited; the gradual withdrawal of the nitrogen gas again causes the co-deposition of titanium and titanium nitride, thus forming a graded titanium nitride layer which is richer in titanium content adjacent the inner and outer titanium layers. Finally, the outer layer of pure titanium is deposited in the absence of the nitrogen gas. The result is an integral tri-layer coating in which the titanium inner or base layer has excellent bonding strength for the refractory coating of the fibers such as silicon carbide, and the titanium outer or surface layer has excellent bonding strength for the refractory coating of the fibers such as silicon carbide, and the titanium outer or surface layer has excellent bonding strength and compatibility for the metal matrix, and in which the graded titanium nitride middle layer provides a stable barrier against chemical reaction between the fiber and the titanium alloy or intermetallic matrix, even at elevated temperatures of 900° C. and higher, and prevention of cracking in metal matrix layers after thermal exposure.

As discussed supra, this principle applies to the provision of graded chemical reaction barrier layers between super alloy metal matrices, such as titanium alloys and intermetallics, and reinforceing fibers of various types which are reactive with the superalloy under vigorous conditions of temperature and stress. The most reactive of such fibers are carbon-containing fibers. In all cases the present tri-layer coating comprises a sandwich of a stoichiometric compound central layer which is non-reactive with the fiber substrate and with the titanium alloy or intermetallic matrix (but does not have temperature-stable direct adhesion or bonding strength for the fiber or for the titanium alloy or intermetallic matrix), and inner and outer layers of a refractory metal having good adhesion or bonding strength for the fiber and for the titanium alloy or intermetallic matrix. The tri-layer intermediate coatings provide matched thermal expansion properties with the matrix material since layers which are similar in composition are also similar in thermal expansion and have good compatibility and bonding properties relative to each other.

DETAILED DESCRIPTION OF THE INVENTION

The novel reinforcing fibers of the present invention and the novel metal matrix composites incorporating such fibers are based upon the discovery that the two most important causes of loss or severe degradation of tensile strength of fiber-reinforced metal composites, particularly titanium alloy and intermetallic matrix composites, are interfacial chemical reactivity at elevated temperatures and thermal expansion mismatch. Both of these problems result in a breakdown or weakness at the interfacial areas between the reinforcing fiber surfaces and the metal matrix. Such breakdown or weakness causes delamination of disbonding and cracking of the reinforcing fibers particularly at the elevated temperatures at which fiber-reinforced metal matrix composites are desired to be used, i.e., 900° C. and higher. Matrix fracture at the fiber interfaces due to thermal expansion mismatch, residual stresses and adhesion properties controls the performance of the composite. We have discovered that such matrix fracture can be substantially reduced or prevented by insulating the reinforcing fibers from the metal matrix by means of a multilayer coating, comprising a sandwich of a middle layer of a refractory metal compound from the group consisting of nitrides, borides, carbides, oxides and silicides, preferably graded to have a stoichiometric center of the refractory metal compound and which gradually becomes more metal-rich towards the surfaces thereof away from the center, and inner and outer layers comprising the substantially pure metal.

In making the present titanium nitride-coated fibers the base reinforcing fiber, prepared in a conventional way such as according to U.S. Pat. No. 4,315,968, may be sputter-coated with a thin layer of titanium and then fed to a CVD reactor. Titanium halide, nitrogen, argon and propane are fed to the reactor in quantities to deposit on the titanium layer a titanium-rich TiN base stratum. Then additional nitrogen is added to deposit a stoichiometric titanium nitride central stratum. Gradually nitrogen is discontinued, to deposit a titanium rich TiN outer stratum, to complete the formation of the central graded layer of TiN. Finally, an outer-layer of pure titanium or other compatible refractory metal is applied over the graded TiN layer to form filaments which can be readily wetted by and bonded to titanium super alloys during casting, hot molding or diffusion bonding consolidation and fabrication processes to produce superior metal matrix composite materials.

While a vapor deposition reactor may be used to carry out the present coating process, it should be understood that a conventional cylindrical magnetron that uses an elongate cylindrical tube of the refractory metal, such as titanium, may be used as a sputtering target. An intensive magnetron plasma is concentrated on the inside of the tubular target and sputtering takes place uniformly around the fibers which are passed through the elongate tube. The graded coating may be formed over the base titanium layer on the fiber surface by providing the elongate cylindrical target with corresponding graded elongate sections comprising a sputter layer of titanium-rich TiN which gradually changes to stoichiometric proportions of N and Ti, to deposit the central area. The ratio of titanium to nitrogen in the final elongate section of the sputter target gradually increases to form a Ti-rich surface area.

The present intermediate tri-layer coatings generally have a thickness between about 5% and 15% the radius of the reinforcing fiber to which they are applied. For example, when applied to graded silicon carbide-coated fibers, according to U.S. Pat. No. 4,315,968 and having a radial thickness of about 63 um, the present tri-layer coatings preferably have a combined thickness of about 6.3 um, or 10% of the radius of the base fiber, tend to crack and peel off during testing at 1050° C. for 30 minutes in vacuum. Thick coatings, greater than about 15% of the radius of the base fiber, develop a columnar structure during such testing. Preferably the TiN central layer has a thickness about twice that of each titanium layer.

The present novel fibers produce excellent results when incorporated to reinforce high temperature titanium alloys and intermetallics such as Ti-64 and alpha 2 titanium aluminide.

It is to be understood that the above described embodiments of the invention are illustrative only and that modifications throughout may occur to those skilled in the art. Accordingly, this invention is not to be regarded as limited to the embodiments disclosed herein but is to be limited as defined by the appended claims.

We claim:

1. A fiber-reinforced metallic matrix composite having improved resistance to degradation of tensile strength at elevated temperatures, comprising a titanium alloy or intermetallic matrix having bonded therewithin a plurality of reinforcing fibers, said fibers being coated with a multi-layer coating containing inner and outer layers, bonded to the fibers and the metal matrix, respectively, the bonded surfaces of which consist of a refractory metal which is compatible with titanium or with another metal which is compatible with titanium or with another metal which is present in said alloy, and a middle barrier layer comprising a stoichiometric refractory metal compound comprising a nitride, boride, carbide, oxide or silicide of a refractory metal, said coating providing a barrier against interfacial chemical reaction between said fibers and said alloy, even at elevated temperatures, and providing increased resistance to cracking and degradation of tensile strength by reducing the thermal expansion differential at the interface between the metal matrix and the reinforcing fibers.

2. A composite according to claim 1 in which said alloy is selected from the group consisting of Ti—6Al—4V and Ti—23Al—10Nb—3V—1Mo.

3. A composite according to claim 1 in which said fibers comprise a core of carbon, boron or tungsten and a silicon carbide barrier layer.

4. A composite according to claim 1 in which said middle barrier layer comprises a graded mixture of a refractory metal and a refractory metal compound, the concentration of said refractory metal in said mixture being greater at the surfaces of said layer, adjacent said inner and outer refractory metal layers, and gradually diminishing down to about stoichiometric proportions at the center of said layer.

5. A composite according to claim 1 in which said multi-layer coating is a tri-layer coating of Ti—TiN—Ti.

6. An improved reinforcing fiber for titanium alloy and intermetallic matrix composites comprising a base fiber having thereon a multilayer coating having a base layer, bonded to the fiber, which consists of a refractory metal, a central barrier layer comprising a refractory metal compound comprising a nitride, boride, carbide, oxide or silicide of a refractory metal, and an outer layer which consists of a refractory metal, said outer layer having good bonding strength for a titanium alloy or intermetallic matrix, said central layer providing a barrier against interfacial chemical reaction between said fiber and said matrix even at elevated temperatures, and reducing the thermal expansion differential between said fiber and said alloy matrices.

7. A reinforcing fiber according to claim 6 in which said base fiber comprises a core of carbon, boron or tungsten coated with a ceramic barrier layer.

8. A reinforcing fiber according to claim 6 in which said central barrier-layer comprises a graded mixture of a refractory metal and a refractory metal compound, the concentration of said refractory metal in said mixture being greater at the surfaces of said layer, adjacent said inner and outer refractory metal layers, and gradually diminishing down to about stoichiometric proportions at the center of said layer.

9. A reinforcing fiber according to claim 6 on which said multi-layer coating is a tri-layer coating of Ti—TiN—Ti.

* * * * *